US008047623B2

(12) United States Patent
Kang et al.

(10) Patent No.: US 8,047,623 B2
(45) Date of Patent: Nov. 1, 2011

(54) REFRIGERATOR

(75) Inventors: Byeong Gyu Kang, Changwon-si (KR); Jae Youl Lee, Changwon-si (KR); Gi Dong Kwon, Changwon-si (KR); Soon Woo Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 758 days.

(21) Appl. No.: 12/078,767

(22) Filed: Apr. 4, 2008

(65) Prior Publication Data

US 2008/0246382 A1 Oct. 9, 2008

(30) Foreign Application Priority Data

Apr. 6, 2007 (KR) ..... 10-2007-0034279

(51) Int. Cl.
*A47B 96/00* (2006.01)

(52) U.S. Cl. ..... 312/408

(58) Field of Classification Search ..... 312/401, 312/402, 404, 408, 410, 306, 312, 319.1, 312/319.5; 211/187; 62/382, 440
See application file for complete search history.

(56) References Cited

U.S. PATENT DOCUMENTS

| | | | | |
|---|---|---|---|---|
| 3,982,801 | A * | 9/1976 | Heidorn et al. | 312/306 |
| 5,199,778 | A * | 4/1993 | Aoki et al. | 312/408 |
| 6,065,821 | A * | 5/2000 | Anderson et al. | 312/408 |
| 7,178,890 | B2 * | 2/2007 | Park et al. | 312/408 |
| 2001/0025508 | A1 * | 10/2001 | Nakajima et al. | 62/440 |
| 2004/0263037 | A1 * | 12/2004 | Ritchie et al. | 312/405.1 |
| 2005/0145704 | A1 * | 7/2005 | Hwang | 236/44 A |

* cited by examiner

*Primary Examiner* — James O Hansen

(74) *Attorney, Agent, or Firm* — Birch, Stewart, Kolasch & Birch, LLP

(57) ABSTRACT

A refrigerator includes a main body having a storage chamber; a shelf movably provided to the inside of the storage chamber; a guide unit guiding a movement of the shelf; and a transfer means provided at least one side of the shelf and transferring driving power for moving the shelf. Through such a configuration, it is possible to adjust height of the shelf, without drawing out the shelf to the outside of the storage chamber.

19 Claims, 5 Drawing Sheets

REFRIGERATOR

BACKGROUND

The present disclosure relates to a refrigerator, and more particularly, to a refrigerator, a door for a refrigerator, and a dispensing apparatus for a refrigerator that enable to obtain contents easily.

The present embodiment relates to a refrigerator, and more specifically to a refrigerator having a shelf that partitions an inner space of a chilling chamber.

Generally, a refrigerator, which is an apparatus for storing foods, generates cooling air using a cycle of compression-condensation-expansion evaporation.

Also, the refrigerator includes a plurality of storage chambers receiving foods for storing foods in a freezing state or a cooling state. And, one surface of the storage chamber may be opened to receive and take out foods and one side of the storage chamber is rotatably coupled with a refrigerator door.

Generally, the storage chamber is partitioned into a cooling chamber and a freezing chamber. And, the refrigerator may be sorted into a top mount type refrigerator wherein the cooling chamber is positioned on a lower side of the freezing chamber, a side by side type wherein the freezing chamber and the cooling chamber are provided left and right, and a bottom freezer type wherein the freezing chamber is positioned on the lower side of the cooling chamber and three doors are provided, according to an installation way of the cooling chamber and the freezing chamber.

Also, the storage chamber is provided with a plurality of shelves that partition an inner space into a predetermined size and receives foods.

Generally, the shelf is supported on both walls of the inside of the main body of refrigerator. In this case, the main body of refrigerator is provided with a supporting part supporting both sides of the shelf and the position of the shelf may be defined by the position of the supporting part. A plurality of supporting parts with different heights may be provided.

And, the position of the shelf may be changed to be supported by the supporting parts positioned at different heights. Therefore, when an interval between the shelves is controlled according to a height of an object received in the inside of the chilling chamber, the shelf should be drawn out to the outside and then be inserted again.

In the process, there is a risk that the object received on the shelf falls and there is a problem in that it is difficult to accurately control the position of the shelf according to the height of the object.

SUMMARY

It is an object of the present embodiment to provide a shelf whose height is easily controlled by improving a structure of the shelf in a refrigerator according to the present embodiment.

Also, it is an object of the present embodiment to provide a shelf whose height is easily controlled by moving the shelf along a guide unit in a refrigerator according to the present embodiment.

Also, it is an object of the present embodiment to provide a shelf whose height is easily controlled by a linear movement of a control part in a refrigerator according to the present embodiment.

Also, it is an object of the present embodiment to provide a guide unit guiding a movement of a shelf and detachably formed in the inside of a chilling chamber to a refrigerator according to the present embodiment.

In order to accomplish the objects, there is provided a refrigerator according to the present embodiment, comprising: a main body having a storage chamber; a shelf movably provided to the inside of the storage chamber; a guide unit guiding a movement of the shelf; and a transfer means provided at least one side of the shelf and transferring driving force for moving the shelf.

Also, there is provided a refrigerator according to another aspect of the present embodiment, comprising: a main body having a storage chamber; a shelf provided movably up and down in the inside of the storage chamber; a guide unit provided at one side of the shelf and including a first gear guiding the movement of the shelf; a second gear engaged and rotated with the first gear; and a power transfer part provided with a rotation axis for rotating the second gear.

There is provided a refrigerator according to another aspect of the present embodiment, comprising: a main body having a storage chamber; a shelf movably provided to the inside of the storage chamber; a transfer means providing driving force for moving the shelf; a guide unit communicated with the transfer means to guide the movement of the shelf; and a supporting part detachably supporting the guide unit to the main body.

There is provided a refrigerator according to another aspect of the present embodiment, comprising: a main body having a storage chamber; a shelf provided movably in the inside of the storage chamber; a rack gear guiding the movement of the shelf; a pinion gear engaged and movably rotated with the rack gear; a power transfer part provided with a rotation axis for rotating the pinion gear; and a control part providing driving force to the power transfer part and performing a linear movement.

With the refrigerator according to the present embodiment, the height of the shelf can be controlled without being drawn out to the outside of the storage chamber.

Also, an assembly including the guide unit and the shelf is detachably provided in the refrigerator to selectively use a general shelf and a height controllable shelf.

Also, a user controls the height of the shelf by moving the control part positioned at the front of the shelf left and right to increase the convenience of use.

Also, in the process of moving the shelf upwardly, the shelf can easily be raised along the guide unit by the restoring force of an elastic member.

Also, the shelf according to the present embodiment is provided the elastic member and a bar to prevent the shelf from sliding along the guide unit.

DETAILED DESCRIPTION OF THE EMBODIMENTS

Figure 1:
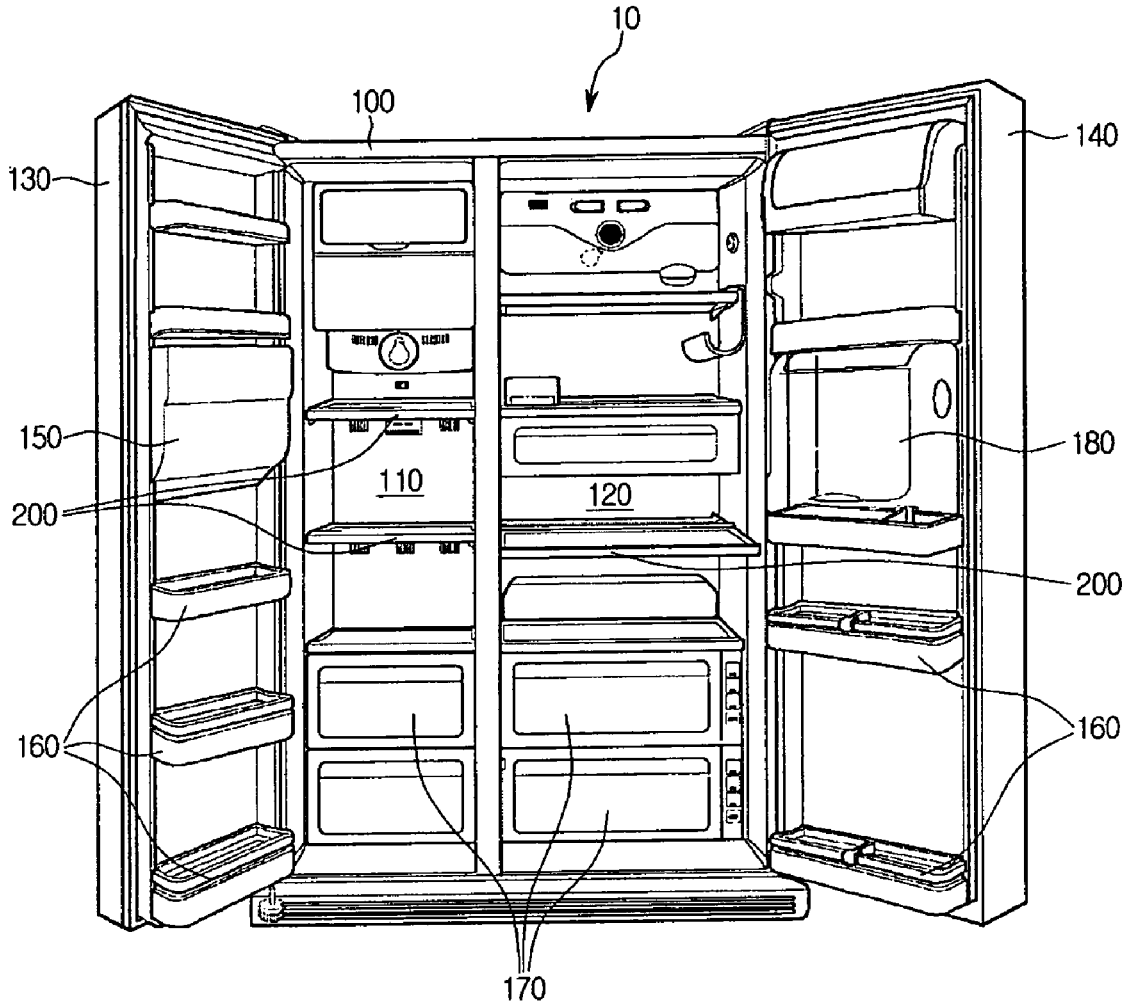
FIG. 1 is a view showing a refrigerator according to one embodiment of the present invention.

FIG. 1 is a view showing a refrigerator according to one embodiment of the present invention.

Referring to FIG. 1, a refrigerator 10 according to one embodiment of the present invention is provided with a main body 100 forming an outer appearance. And, the inside of the main body 100 is formed with a storage chamber storing foods, wherein the storage chamber is partitioned into the left and right, that is, a freezing chamber 110 and a cooling chamber 120.

And, the front surfaces of the freezing chamber 110 and the cooling chamber 120 are opened and are selectively closed by means of a freezing chamber door 130 and a cooling chamber door 140, respectively.

Also, the freezing chamber door 130 is provided with a dispenser 150 for taking out water purified from the outside. The cooling chamber door 140 is selectively provided with a home bar 180 storing foods that are frequently taken out. Also, the rear surfaces of the freezing chamber door 130 and the cooling chamber door 140 includes a plurality of baskets 160 for receiving beverage bottle, can, etc. and a storage space for storing dairy products or eggs, etc.

Also, the insides of the cooling chamber 140 and the freezing chamber 130 may be provided with a plurality of storage boxes 170 forming a space for storing foods.

Generally, the storage box 170 is provided at a lower side of the inside of the main body 100 and is provided in a drawer type so that it may be configured to put in and draw out forward/backward from the inside of the main body 110.

Meanwhile, the inside of the main body 100 is provided with a plurality of shelves for receiving foods. And, the main body 100 is provided at one side of the shelf 200 and is provided with a guide unit 300 (see FIG. 2) performing a guide to control a height of the shelf 200.

Hereinafter, a configuration of the guide unit and a coupling relation of the shelf and the guide unit will be described with reference to the accompanying drawings.

Figure 2:
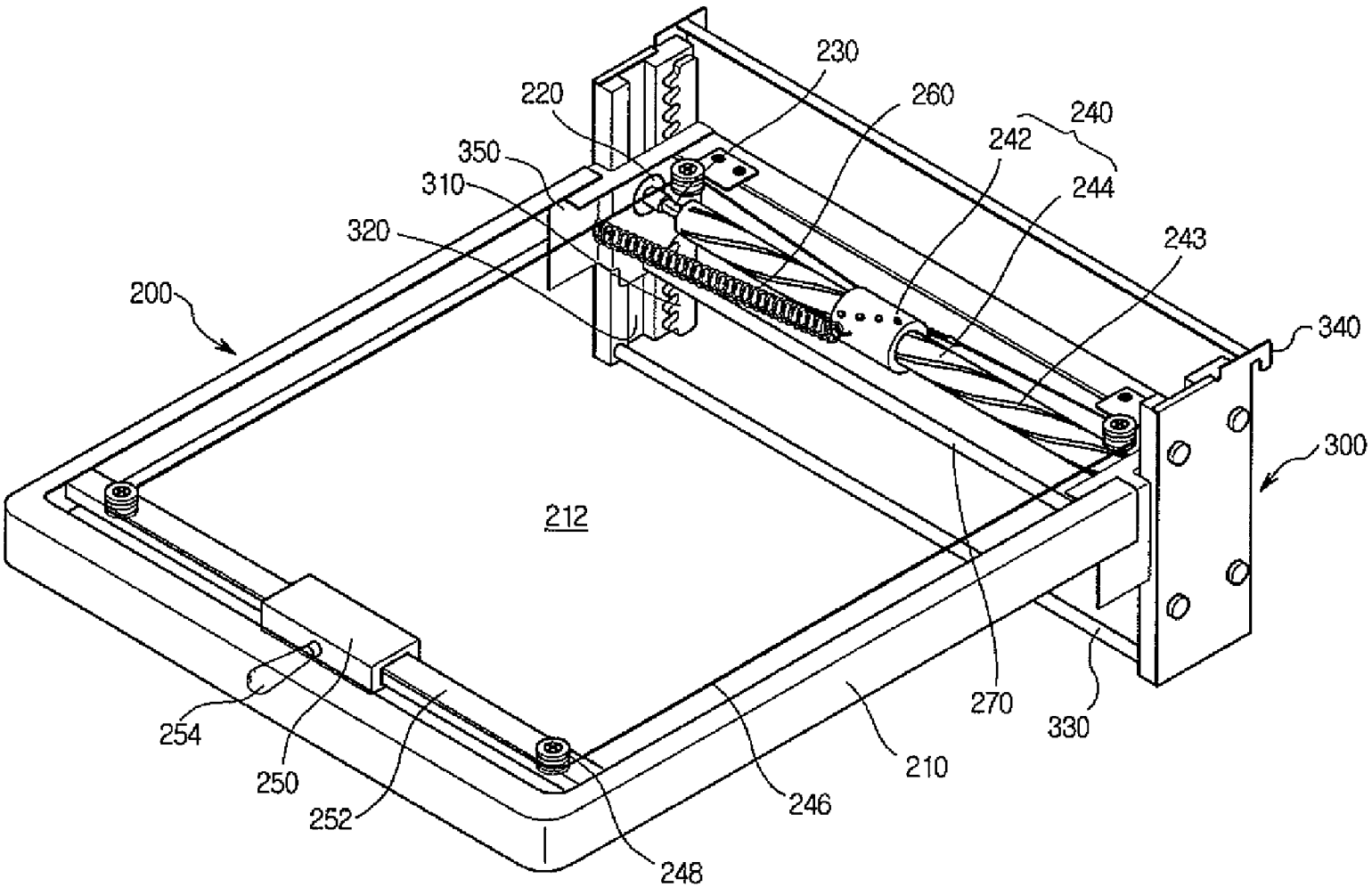
FIG. 2 is a perspective view showing a structure of a shelf according to the embodiment of the present invention.
Figure 3:
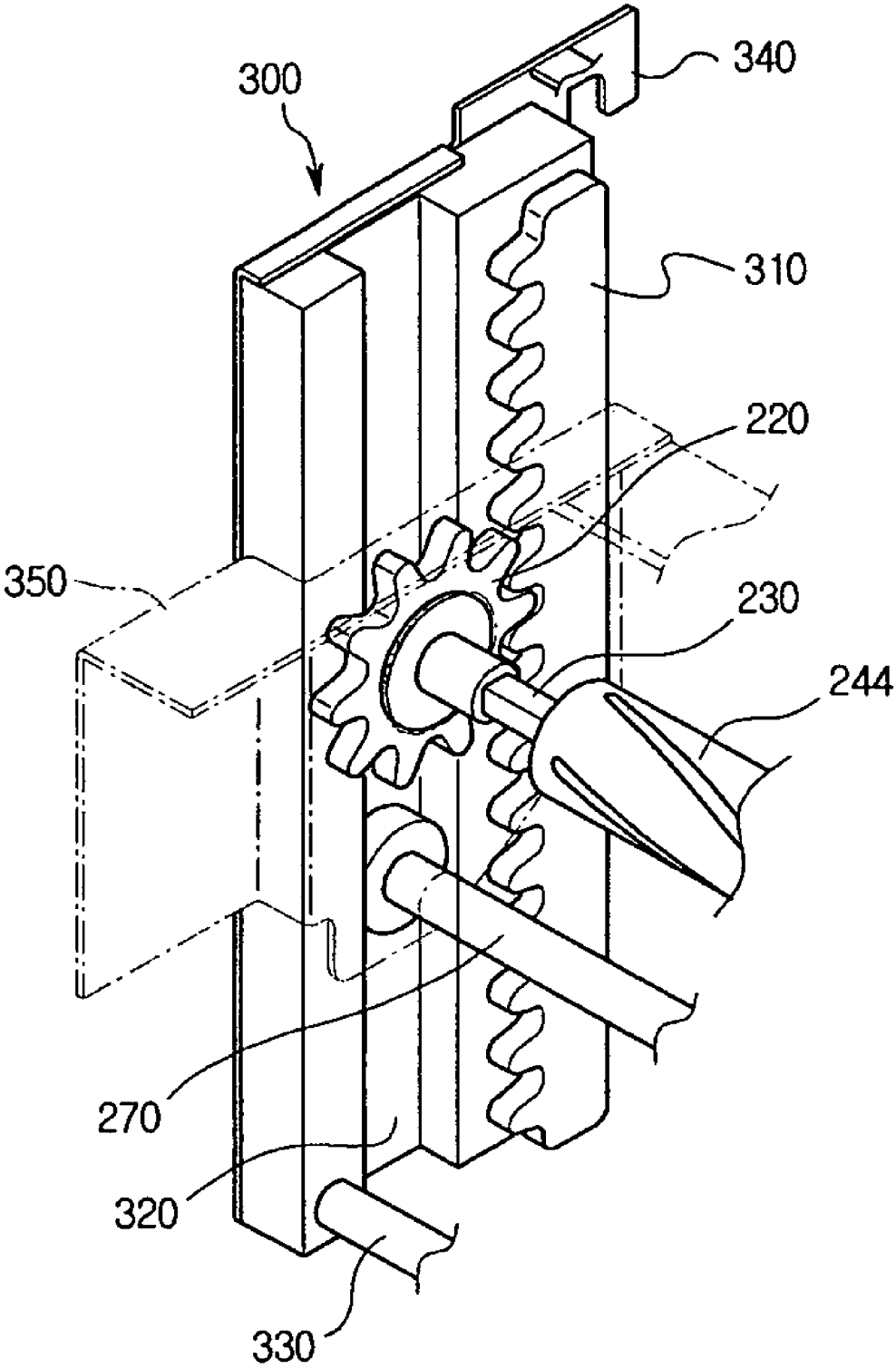
FIG. 3 is a partial perspective view showing a coupling structure of a guide unit and the shelf according to the embodiment of the present invention.
Figure 4:
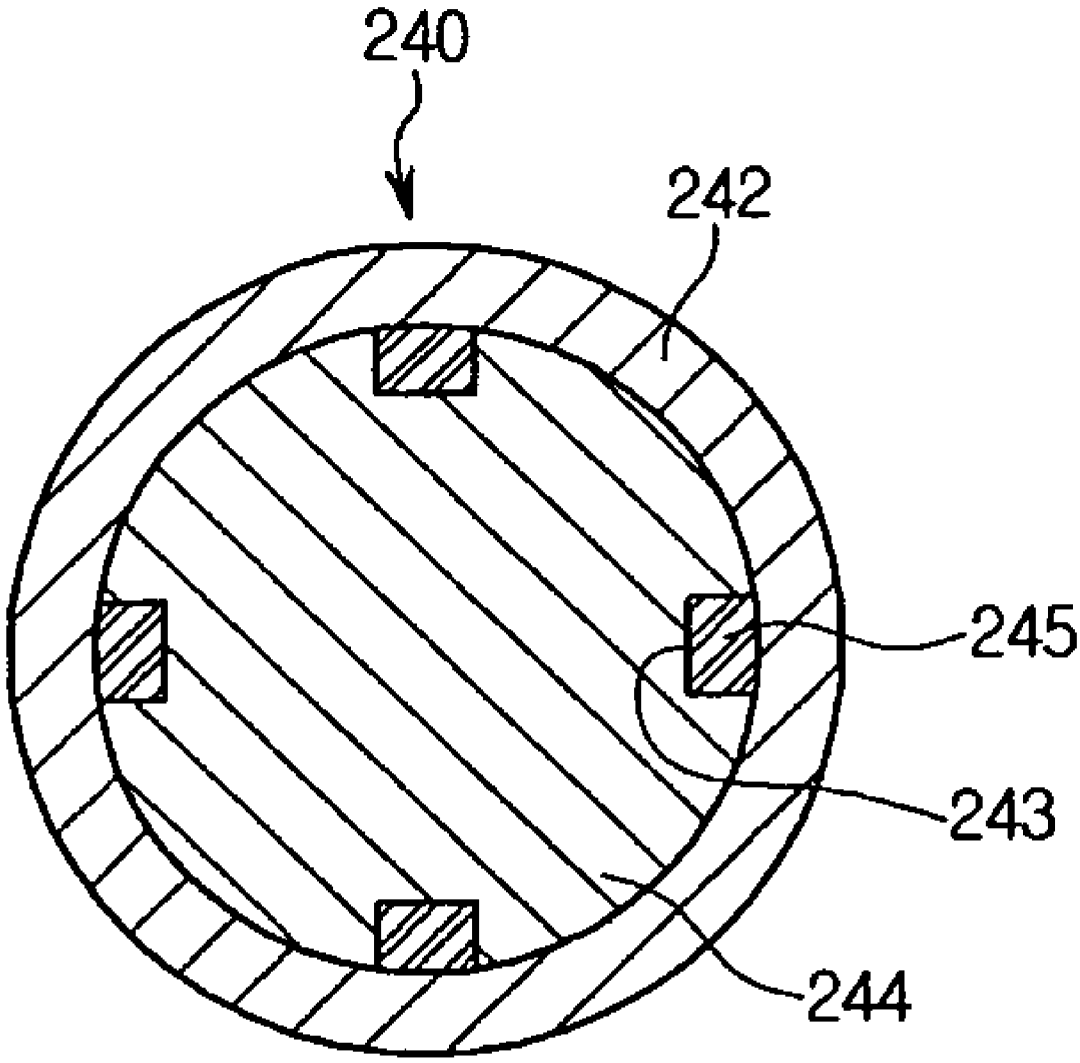
FIG. 4 is a cross-sectional view taken along line I-I' of FIG. 2.

FIG. 2 is a perspective view showing a structure of a shelf according to the embodiment of the present invention, FIG. 3 is a partial perspective view showing a coupling structure of a guide unit and the shelf according to the embodiment of the present invention, and FIG. 4 is a cross-sectional view taken along line I-I' of FIG. 2.

Referring to FIGS. 2 to 4, the refrigerator according to one embodiment of the present invention includes a shelf 200 partitioning the space of the freezing chamber 110 and the cooling chamber 120 to receive foods and a guide unit 300 provided at one side of the shelf to guide up and down movement of the shelf 200.

In detail, the shelf 200 includes a frame 210 defining the outer appearance and size of the shelf and a plate 212 fixed by the frame 210 and forming one surface receiving foods.

And, the shape of the frame 210 and the plate 212 corresponds to the inner space of the freezing chamber 110 and the cooling chamber 120 and generally has a rectangular shape.

Also, both sides of the rear of the shelf are provided with a connection plate 350 to connect the shelf 200 to the guide unit 300. And, the connection plate 350 may be coupled with the rear end of the shelf 200 by means of a bonding or an engaging method. Of course, the connection plate 350 may integrally be formed with the shelf 200.

In other words, the connection plate 350, which is a portion of the shelf 200, provides a connection structure for guiding the shelf 200 by means of the guide unit 300.

Also, an outer side of the connection plate 350 on both sides is provided with a cylindrical gear 220 rotated in the course of the movement of the shelf 200.

And, as the cylindrical gear 220, a spur gear, a helical gear, etc, can be applied, any gears capable of performing a role of a pinion engaged and rotated with a rack gear 310 to be described later can be applied.

Meanwhile, the guide unit 300 includes the rack gear 310 that is provided at an outer side of the connection plate and is engaged with the cylindrical gear 220 to guide the movement of the shelf 200. And, the rack gear 310 may be provided at a position engaged with the cylindrical gear 220.

In other words, the cylindrical gear 220 is engaged and rotated with the rack gear 310 and the shelf 200 rises or falls in a direction corresponding to a rotation direction according to the guide unit 300.

Herein, the cylindrical gear 220 and the rack gear 310 may be positioned in a pair at both sides of the shelf 200. The reason is that the shelf 200 should be supported at more than two places not to be inclined in any one direction so that the object is easily received.

Also, the rotation axis 230 is provided between the gears 220 so that it provides driving force to rotate the cylindrical gears 220. In other words, the cylindrical gear 220 is provided at both ends of the rotation axis 230.

And, the cylindrical gear 220 provided at both sides of the shelf 200 is connected by the rotation axis 230 and may be rotated by the rotation of the rotation axis 230.

Also, an outer peripheral surface of the rotation axis 230 is provided with a power transfer part 240 fixed to the rotation axis 230 and providing a rotating force to the rotation axis 230. In other words, the rotating axis 230 is formed to penetrate through the power transfer part 240.

In detail, the power transfer part 240 includes a linear moving driver 242 in a horizontal direction by an operation of a user and a following part 244 connected to the driver 242 and rotated according to the movement of the driver 242.

Also, the following part 244 is a hollow cylindrical shape and the rotation axis 230 penetrates through the inside of the following part 244. And, the following part 244 and the rotation axis 230 are fixed to each other to be rotated together.

Meanwhile, the outer peripheral surface of the following part 244 is formed with a collapsed spiral groove 243. Herein, the spiral groove 243 may be formed in a spiral direction from one side end to the other side end.

And, the driver 242 is movably provided at the outer peripheral surface of the follower 244. Herein, the driver 242 and the following part 244 may be arranged in a state spaced by a predetermined distance so that the driver 242 could be easily moved.

Also, the inner peripheral surface of the driver 242 is formed with a projection 245 movably inserted along the spiral groove 243. And, the plurality of projections 245 may be provided at a position corresponding to the spiral groove 243.

Meanwhile, in the coupled state of the projection 245 and the spiral groove 243, if the driver 242 is linearly moved, the projection 245 is moved along the spiral groove 243. Then, the following part 244 may be guided and rotated by the projection 245.

In other words, the linear movement of the driver 242 is converted into the rotation movement of the following part 244 by the action of the projection 245 and the spiral groove 243.

Also, both sides of the driving part 242 is provided with a wire 246 transferring power generated by means of the operation of the user to the driving part 242. And, the wire 246 is connected to both side ends of the driving part 242 to move in one direction so that the driving part 242 linearly moves.

Also, four edges of the shelf 200 are provided with a roller 248 turning the moving direction of the wire 246 while the wire 246 moves. Herein, the wire 246 is placed in a manner that it is rolled on the outer peripheral surface of the roller 248.

That is, the wire 246 is direction-turned by means of the roller 248 so that the force is transferred to the driving part 242. And, the roller 248 moves together with the wire 246, making it possible to minimize loss of the force when turning the direction.

Meanwhile, the front of the shelf 200 is provided with a control part 250 connected to the wire 246, and operated by the user for the movement of the shelf 200.

More specifically, the wire 246 is connected to both sides of the control part 250, and allows power to be transferred to the driving part 242 according to the movement of the control part 250.

And, the wire 246 is direction-turned by means of the roller 248 at the four edges of the shelf 200 and is connected to the driving part 242 positioned on the rear of the shelf 200.

Also, the control part 250 can linearly move in the right and left directions. And, one side of the front surface of the frame 210 is provided with a guide rail 252 guiding the movement of the control part 250.

More specifically, the guide rail 252 is positioned on the front of the shelf 200, and the both ends thereof are fixed to the frame 210. And, the guide rail 252 is placed to penetrate through the inside of the control part 250 in order that the control part 250 easily moves. And, the control part 250 can move in the right and left directions on the upper side of the guide rail 252.

Also, the front surface of the control part 250 is provided with a handle 254 allowing the user to easily operate the control part 250. Therefore, the control part 250 can move by operating the handle 254.

In summary, the cylindrical gear 220, the power transfer part 240, the wire 246 and the control part 250 can be considered as a transfer means providing and transferring driving force for the movement of the shelf 200.

Hereinafter, the operation of the shelf 200 and the guide unit 300 according to the above configuration will be described.

First, if the user operates the handle 254 so that the control part 250 moves right, the driving part 242 receives force through the wire 246 to move left.

Then, the following part 244 rotates by means of the movement of the driving part 242. Herein, a rotation direction of the following part 244 becomes clockwise when viewed from the right side of the shelf 200. And, the rotation axis 230 and the cylindrical gear 220 can rotate in the same direction as a rotation direction of the following part 244.

And, while the cylindrical gear 220 is rotated, it can be engaged with the rack gear 310 to be raised. As a result, the shelf 200 can be raised in the movement direction of the cylindrical gear 220

Meanwhile, since the control part 250 linearly moves in the right and left directions, the user can easily predict a degree of the movement of the shelf 200 in a process of controlling the height of the shelf 200. Therefore, the height of the shelf 200 can be easily adjusted.

Also, between any one of the connecting plates 350 on both sides and the driving part 242 is provided an elastic member 260 through which a predetermined elastic force acts in order to allow the shelf 200 to be easily raised or lowered according to the movement of the driving part 242.

More specifically, the elastic member 260 can be installed so that the movement direction of the driving part 242 allowing the shelf 200 to be raised and the action direction of the restoring force of the elastic member 260 coincide.

For example, as shown in FIG. 2, when considering a connecting position of a spiral groove 243 of the following part 244 and the driving part 242, the shelf 200 is raised in a process that the driving part 242 moves left.

At this time, the elastic member 260 can be a tension spring installed between the driving part 242 and the connecting plate 350.

With the above configuration, the elastic member 260 not only helps the shelf to be able to be easily raised, but also performs a role preventing the shelf from being easily lowered.

In summary, since the movement direction (a raising direction) of the shelf 200 by means of the restoring force of the elastic member 260 is opposite to the direction of gravity, the shelf 200 and at least a portion of weight of food and drink received in the shelf 200 can be offset.

In addition to this, if a configuration of the elastic member 260 is a configuration in which the raising direction of the shelf 200 and an action direction of the restoring force coincide, it can be variously modified.

Meanwhile, the guide unit 300 includes a guide groove 320 provided spaced by a predetermined distance in a direction parallel with the rack gear 310 on the one side of the rack gear 310 and guiding the movement of the shelf 200 and the cylindrical gear 220 in a process that the shelf 200 moves.

Also, the inside of the guide groove 320 is provided with a guide bar 270 capable of moving in the up and down direction in the state where it is inserted into the guide groove 320. Herein, the guide bar 270 is provided in a transverse direction of the shelf 200, and penetrates through the connecting plates 350 of both sides to be inserted into the guide groove 320.

And, the guide bar 270 can be arranged in the up and down direction with regard to the rotation axis.

And, the guide bar 270 moves along the guide groove 320 in a process that the shelf 200 moves in the up and down direction.

As a result, the guide groove 320 and the guide bar 270 perform a role guiding movement of the shelf 200, together with the cylindrical gear 220 and the rack gear 310.

Also, the lower end of the guide unit 300 is provided with a locking bar 330 setting a minimum range within which the shelf 200 can move downwardly and preventing the shelf 200 from being separated from the guide unit 300. And, the locking bar 330 can be fixed between both ends of the guide unit 300.

Figure 5:
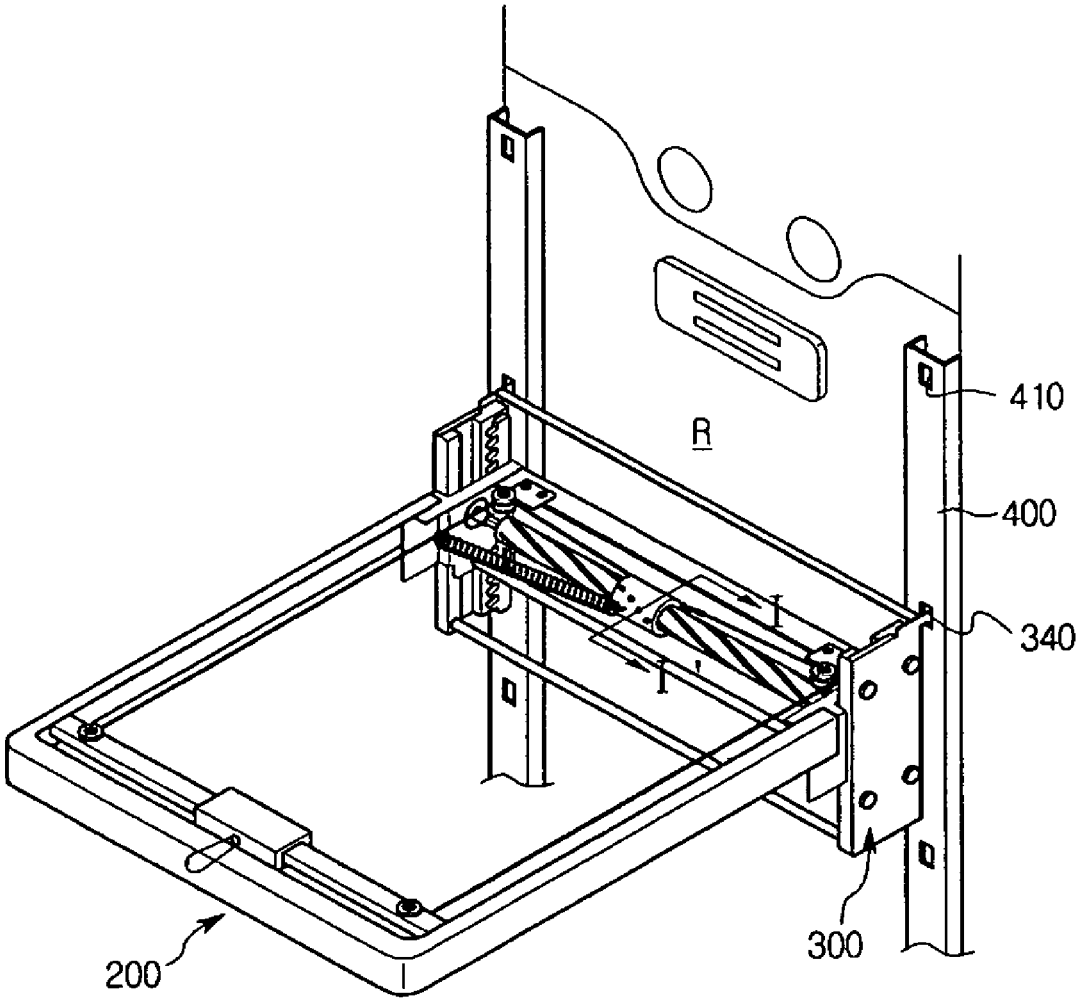
FIG. 5 is a perspective view showing a shape that the guide unit and the shelf according to the present embodiment is mounted on the refrigerator.

FIG. 5 is a perspective view showing the guide unit and the shelf according to one embodiment of the present invention mounted on the refrigerator.

Referring to FIG. 5, the guide unit 300 is formed with a locking unit 340 allowing the shelf 200 to be detachable to the storage chamber R of the refrigerator in the state where the shelf 200 is coupled to the guide unit 300.

More specifically, the locking unit 340 is provided to both sides of the upper of the guide unit 300, and is protruded toward the rear of the guide unit 300. And, an end of the locking unit 340 is bent downwardly, wherein the bent portion thereof can be locked to the storage chamber R.

Also, the both sides of the inside of the storage chamber R are provided with a supporting unit 400 supporting the guide unit 300. And, the supporting unit 400 is formed with a locking groove 410 formed in a position corresponding to the locking unit 340 of the guide unit 300 to be locked to the locking unit 340.

And, a plurality of locking grooves 410 can be formed in the state where they are spaced from each other in a length direction of the storage chamber R. Therefore, height of the shelf 200 can be adjusted according to a position of the locking groove 410 into which the locking unit 340 is locked.

Meanwhile, the shelf 200 can be provided to a variety of positions according to selection of the locking groove 410 into which the locking unit is locked. Accordingly, an internal space of the storage chamber R can be partitioned into a various sizes.

What is claimed is:

1. A refrigerator comprising:

a main body having a storage chamber;

a shelf movably provided to the inside of the storage chamber;

a guide unit guiding a movement of the shelf; and a transfer means provided at least one side of the shelf to transfer driving power for moving the shelf, and converting a straight movement into a rotating movement, wherein the transfer means comprises:

a power transfer part including a driving part configured to move straightly;

a following part configured to rotate in a predetermined direction according to a movement of the driving part;

a first gear provided at the guide unit;

a second gear engaged with the first gear and rotating according to the movement of the driving part;

a control part moving by means of operation of a user; and a wire transferring driving power according to a movement of the control part to the power transfer part.

2. The refrigerator according to claim 1, wherein the transfer means comprises an elastic member provided between the shelf and the power transfer part and facilitating a raising movement of the shelf.

3. The refrigerator according to claim 1, wherein the second gear comprises a pinion rotating according to a movement of the power transfer part, and the first gear comprises a rack gear engaged with the pinion.

4. The refrigerator according to claim 1, wherein the shelf and the guide unit are detachably provided in the inside of the storage chamber.

5. A refrigerator comprising:

a main body having a storage chamber;

a shelf provided movably up and down in the inside of the storage chamber;

a guide unit provided at one side of the shelf and including a first gear guiding the movement of the shelf;

a second gear engaged and rotated with the first gear; and a power transfer part provided with a rotation axis for rotating the second gear, the power transfer part including:

a driving part configured to move linearly;

a following part configured to rotate according to a movement of the driving part; and an elastic member provided between the shelf and the power transfer part and facilitating a raising movement of the shelf.

6. The refrigerator according to claim 5, wherein the following part has a spiral groove formed on an outer circumference surface thereof; and the driving part is movably inserted along the spiral groove.

7. The refrigerator according to claim 6, wherein the driving part has a hollow shape, and an inner circumference surface of the driving part is provided with a projection inserted into the spiral groove.

8. The refrigerator according to claim 5, wherein the first gear is a rack gear, and the second gear is a pinion gear engaged with the rack gear.

9. The refrigerator according to claim 5, wherein the guide unit is formed with a guide groove provided at one side of the first gear and guiding an up and down movement of the second gear.

10. The refrigerator according to claim 9, wherein the shelf is provided with a guide bar movably inserted into the guide groove, and the guide bar is arranged in an up and down direction with regard to the rotation axis.

11. The refrigerator according to claim 5, wherein the guide unit comprises a locking bar setting a minimum range in which the shelf can move downward.

12. The refrigerator according to claim 5, wherein the body comprises a supporting part allowing the guide unit to be detachably supported to the body.

13. The refrigerator according to claim 12, wherein the supporting part is formed with a locking groove into which the guide unit is inserted, and the guide unit is formed with a locking part locked into the locking groove.

14. The refrigerator according to claim 13, wherein a plurality of locking grooves are formed in the state where they are spaced from each other in a length direction of the storage chamber.

15. The refrigerator according to claim 13, wherein the locking part is formed to be protruded to the rear of both sides of the guide unit.

16. A refrigerator comprising:

a main body having a storage chamber;

a shelf provided movably in the inside of the storage chamber;

a rack gear guiding the movement of the shelf;

a pinion gear engaged and movably rotated with the rack gear;

a power transfer part provided with a rotation axis for rotating the pinion gear, the transfer part including:

a following part having a spiral groove formed on the outer circumference surface thereof and performing a rotating movement; and a driving part performing a straight movement and engaged with the spiral groove to drive the following part; and a control part providing driving power to the power transfer part and performing a linear movement.

17. The refrigerator according to claim 16, further comprising a wire transferring power from the control part to the driving part.

18. The refrigerator according to claim 17, further comprising a roller converting a movement direction of the wire.

19. The refrigerator according to claim 16, wherein the control part is provided with a knob facilitating operating of the control part.

* * * * *